United States Patent [19]

Hokanson

[11] Patent Number: 4,532,754

[45] Date of Patent: Aug. 6, 1985

[54] TUBE FORMER APPARATUS

[75] Inventor: Ronald A. Hokanson, Pasadena, Tex.

[73] Assignee: Formers of Houston, Inc., Pasadena, Tex.

[21] Appl. No.: 486,942

[22] Filed: Apr. 20, 1983

[51] Int. Cl.[3] ..... B65B 9/00; B65B 61/18

[52] U.S. Cl. ..... 53/451; 53/133; 53/551; 493/302

[58] Field of Search ..... 53/451, 456, 551, 412, 53/133; 493/302, 250, 468

[56] References Cited

U.S. PATENT DOCUMENTS

| | | | |
|---|---|---|---|
| 2,969,627 | 1/1961 | Leasure | 53/451 |
| 3,027,695 | 4/1962 | Leasure | 53/451 |
| 3,425,185 | 2/1969 | Samways et al. | 493/250 |
| 3,486,424 | 12/1969 | Tanner | 53/451 |
| 3,636,826 | 1/1972 | Bowen et al. | 53/551 |
| 4,194,438 | 3/1980 | Schmachtel | 493/302 |
| 4,437,853 | 3/1984 | Metz | 493/302 |

*Primary Examiner*—Leonidas Vlachos
*Attorney, Agent, or Firm*—Neal J. Mosely

[57] ABSTRACT

A tube former for turning a strip of thin tube stock, e.g. plastic film, paper, metal foil etc., into a elongated tube comprises a former tube having a curved upper edge tapering from an apex downwardly on opposite sides thereof with a sheet metal winged member is secured along the curved upper edge and extending outward at an acute angle relative to the side of the tube. The winged guide has the wings ending in overlapping relation at one side of the tube and spaced apart so that a strip of thin tube stock drawn over the wings through the former tube is formed into an elongated tube with overlapping edges at the sides of the tube and may be flattened and seamed to produce a longitudinal seam along the side of the flattened tube. The tube former is used with a conventional tube forming apparatus where thin tube stock is fed from rolls over the former. A double sided strip of adhesive is fed along one side of the tube stock to form a releasable longitudinal seam which is pressed together by a press roller working against a backing tongue extending below the tube former. The formed tube is seamed crosswise by heat seal bars. The tube is filled before final sealing.

13 Claims, 8 Drawing Figures

TUBE FORMER APPARATUS

BACKGROUND OF THE INVENTION

1. Field of the Invention

This invention relates to new and useful improvements in bag forming apparatus and more particularly to a novel tube former and a apparatus utilizing said tube former to produce a bag having a releasable side seam.

2. Brief Description of the Prior Art

In conventional bag former apparatus, thin tube stock is fed from feed rolls over a tube former and down through the tube portion of the bag former. The tube stock is converted from a sheet or strip form into a tube having an overlapping seam or a thin seam at the front which is sealed by a continuous heat sealing device positioned in front of and below the tube former. The tube which is formed is subsequently heat sealed crosswise by heat sealing bars positioned below the tube former to form the bottom of a bag. The bag is filled with its desired contents through the bag former tube. The filled bag, which is sealed at the bottom and still open at the top, is moved downward in the apparatus and heat sealing bars seal the top of the bag and the bottom of the next bag and cuts the finished and filled bag from the bag which still to be formed.

Leasure et al U.S. Pat. No. 3,133,390 discloses a bag forming apparatus having a tube former and sealing and cutting die.

Brown et al U.S. Pat. No. 3,918,235 discloses a process for continuously forming compartmented packages in which a sheet of plastic film is passed over a tube former and through the tube of the former to produce the desired structure followed by forming longitudinal heat seals by a plurality of sealing devices.

Hobart U.S. Pat. No. 3,948,153 discloses a tube former which forms a overlapping seal to the front of the bag.

Tanner U.S. Pat. No. 3,486,424 discloses a tube former for tube or bag forming machines having a wear insert.

Reed U.S. Pat. No. 3,257,228 discloses the use of adhesive strips to form releasable seals.

Kratzer et al U.S. Pat. No. 3,307,773 discloses a sandwich bag having a reclosable flap.

SUMMARY OF THE INVENTION

One of the objects of this invention is to provide a new and improved tube former for tube forming apparatus which converts thin tube stock from a sheet or strip form into a tube and forms a longitudinal seal or seam therein.

Another object of this invention is to provide a new and improved tube former for tube forming apparatus which has forming wings overlapping at the edge thereof and thus converts thin tube stock from a sheet or strip form into a tube with a longitudinal seal or seam along one side.

Another object of this invention is to provide a new and improved tube former for tube forming apparatus which converts thin tube stock from a sheet or strip form into a tube and feeds a strip of double sided adhesive strip along one edge of the film to form a releasable longitudinal seal or seam therein.

Still another object of this invention is to provide a new and improved tube former for tube forming apparatus which converts thin tube stock from a sheet or strip form into a tube and feeds a strip of double sided adhesive strip along one edge of the film and includes a press roller and backing tongue to press the overlapping film and adhesive strip to form a releasable longitudinal seal or seam therein.

Still another object of this invention is to provide a new and improved tube forming apparatus including a novel tube former which converts thin tube stock from a sheet or strip form into a tube and forms a longitudinal seal or seam therein.

Yet another object of this invention is to provide a new and improved tube forming apparatus including a novel tube former which has forming wings overlapping at the edge thereof and thus converts thin tube stock from a sheet or strip form into a tube with a longitudinal seal or seam along one side.

Yet another object of this invention is to provide a new and improved tube forming apparatus including a novel tube former which converts thin tube stock from a sheet or strip form into a tube and feeds a strip of double sided adhesive strip along one edge of the film to form a releasable longitudinal seal or seam therein.

A further object of this invention is to provide a new and improved tube forming apparatus including a novel tube former which converts thin tube stock from a sheet or strip form into a tube and feeds a strip of double sided adhesive strip along one edge of the film and includes a press roller and backing tongue to press the overlapping film and adhesive strip to form a releasable longitudinal seal or seam therein.

A further object of this invention is to provide a new and improved method to convert thin tube stock from a sheet of strip form into a tube and form a releasable longitudinal seal or seam therein.

A still further object of this invention is to provide a new and improved method to convert thin tube stock from a sheet or strip form into a tube with a longitudinal seal or seam along one side using a novel tube former having forming wings overlapping at the edge thereof.

A still further object of this invention is to provide a new and improved method for converting thin tube stock from a sheet or strip form into a tube in which a strip of double sided adhesive strip is fed along one edge of the film to form a releasable longitudinal seal or seam thereon.

A still further object of this invention is to provide a new and improved method for converting thin tube stock from a sheet or strip form into a tube in which a strip of double sided adhesive strip is fed along one edge of the film and a press roller and backing tongue press the overlapping film and adhesive strip to form a releasable longitudinal seal or seam therein.

Other objects of this invention will become apparent from time to time throughout the specification and claims as hereinafter related.

These objects and other objects of the invention are accomplished by a tube former for turning a strip of thin tube stock, e.g. plastic film, paper, metal foil, etc., into a elongated tube which comprises a former tube having a curved upper edge tapering from an apex downwardly on opposite sides thereof. A sheet metal winged member is secured around the former tube along the curved upper edge and extends outwardly in an acute angle relative to the side of the tube. The winged guide member has the end winged in overlapping relation at one side of the tube and spaced apart so that a strip of tube stock drawn over the wings through the former tube will be formed into an elongated tube with overlapping edges at the sides of the tube and can be flattened and seamed to produce a longitudinal seam along the side of the flattened tube. The tube former is used with a conventional tube forming apparatus where tube stock is fed from feed rolls over the former. In this invention, a double sided strip of adhesive is fed along one side of the thin tube stock so that a releasable longitudinal seam is formed. The seam is pressed together by a press roller which presses the seam against a backing tongue which extends through and below the tube former. The former tube is seamed crosswise by heat seal bars. The desired product is filled in the tube. An upper cross seam is then formed by heat seal bars and the filled package cut away from the incomplete package which follows it.

DESCRIPTION OF THE PREFERRED EMBODIMENT

This invention relates to a new and improved bag forming apparatus and more particularly an apparatus for forming bags from thin strip material, such as plastic film, metal foil, paper, etc. The conversion of tube stock into tubular form, with longitudinally extending seams, and the formation of bags from such tubes is well known in the prior art.

In the conventional bag forming apparatus, the thin tube stock is fed from feed rolls over a bag former and down through the tube at the center of the bag former. The tube stock is converted from a sheet or strip form into a tube having an overlapping seam or a fin seam at the front which is sealed by a continuous heat sealing device positioned below the bag former. The tube which is thus formed is heat sealed by heat sealing bars positioned below the bag former to form the bottom of a bag. The bag is filled with its desired contents through the bag former tube. The filled bag, which is sealed at the bottom and still opened at the top, is moved downward in the apparatus and the heat sealing bar seals the top of the bag and the bottom of the next bag and cuts the finished and filled bag from the bag which is still to be formed.

In this invention, the bag forming apparatus is designed so that the bag former produces an overlapping seam at the extreme edge of the tube, as viewed from the front of the bag former, and a strip of double sided adhesive is applied to one edge of the tube stock so that the seam which is formed is a releasable seam. The overlapping edges which form the seam and the double sided adhesive are pressed together to form an air tight but releasable seal. A bag is formed from this material by heat sealing one end, filling a portion of the tube, and heat sealing the open end of the bag so that the end seams cause the longitudinal seams to be positioned along the edge of the bag. The apparatus for carrying out the preparation of a bag in this manner and the method of using the apparatus will be described below with reference to the various drawings.

Figure 1:
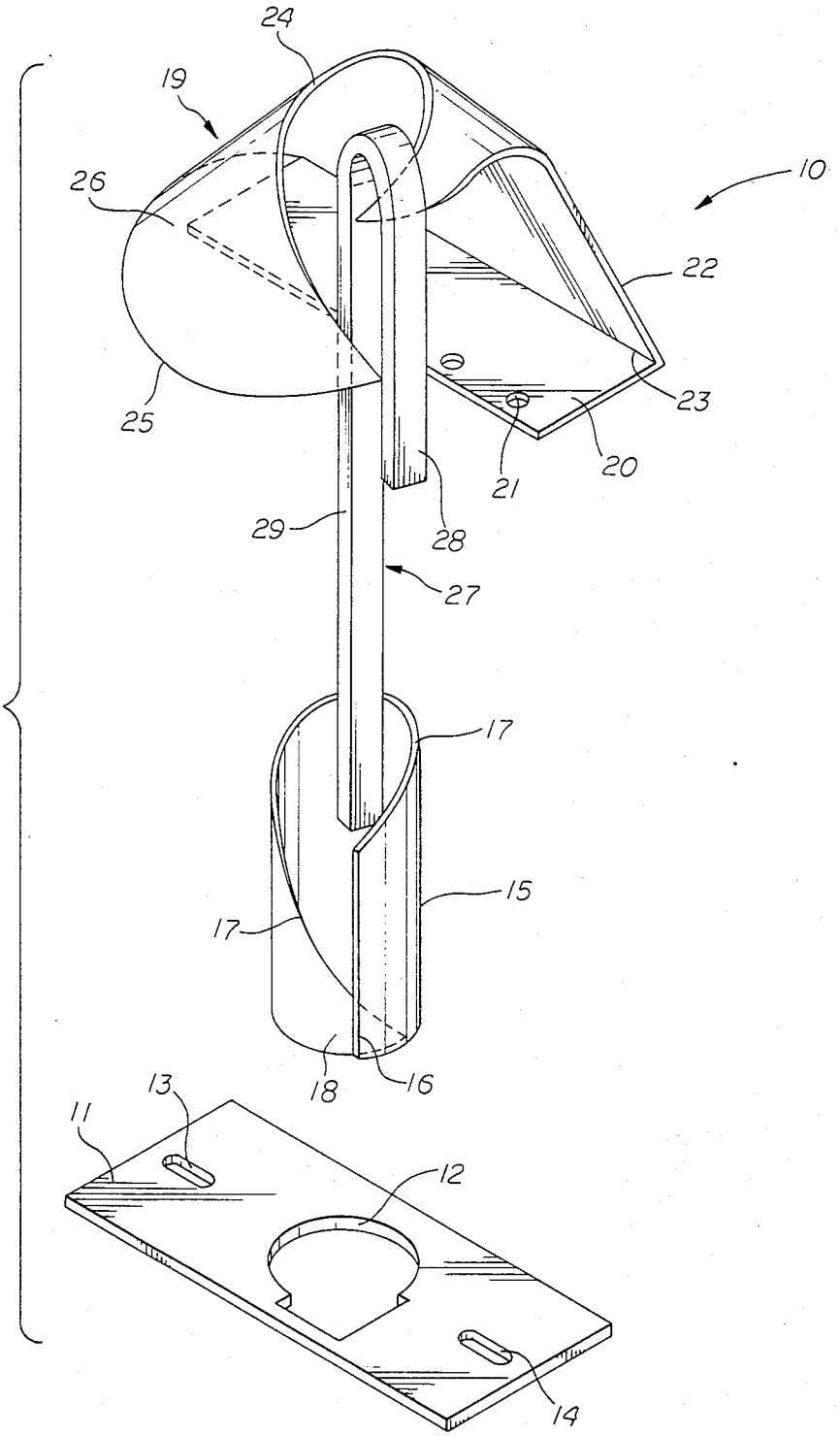
FIG. 1 is an exploded isometric view of a bag former of improved design constituting a preferred embodiment of this invention.

In FIG. 1, there is shown a bag former 10 which is in an isometric, exploded view. Bag former 10 consists of a metal supporting plate 11 having a central opening 12 and elongated holes or apertures 13 and 14. A former tube 15 is positioned in the opening 12 in base plate 11 and secured therein by brazing, welding, or the like. Former tube 15 is of sheet metal and has a vertical edge portion 16 and a curved or arcuate edge 17. The sheet metal former tube 15 is bent into tubular form with the end portion 18 behind and spaced from vertical edge 16. The curved edge 17 extends from the top of vertical edge 16 completely around the tube and down to the bottom of the edge portion 18.

A winged guide sheet 19 is formed of sheet metal and is constructed for assembly on former tube 15 and supporting plate 11. Guide sheet 19 provides bag forming wings substantially as in prior art devices but modified to produce a side seam. Winged guide sheet 19 has a flat base portion 20 with holes 21 for anchoring to supporting 11. The back portion 22 of the winged guide 19 is bent at a acute angle along a fold line 23. Winged guide 19 has curved or arcuate edges 24 and 25. The back portion 22 is bent into winged formers consisting of a curved wing 26 which is bent to form a curved forming wing extending completely around former tube 15 but terminating a short distance before the 18 of guide tube 15 goes behind the vertical edge 16 thereof. The winged guide 19 is secured to former 15 by brazing or welding edge 24 to edge 17 of the former tube.

A backing member or tongue 27 has an inverted "J" shape. Backing member or tongue 27 is made of a metal bar stock and is rebent with a short end 28 welded to a supporting bracket 35 secured to supporting plate 11, and an elongated end 29 which extends through former tube 15 and base plate 11 to a point beyond (i.e. below) the bag former. Backing member or tongue 27 is made integral with the bag former, although it could be provided separately and mounted separately in the bag former assembly. Backing member or tongue 27 provides the support against which the bag seal or seam is formed.

Figure 2:
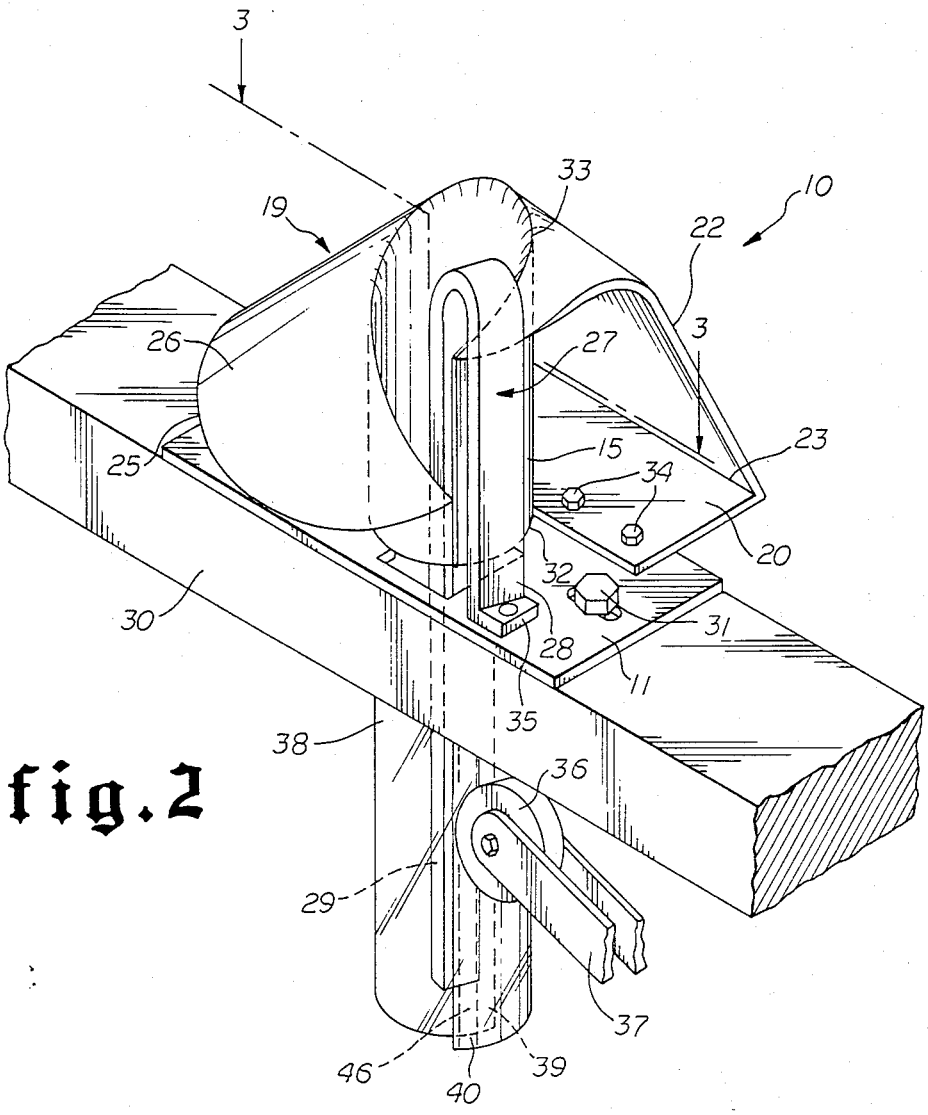
FIG. 2 is an isometric view of the bag former of FIG. 1, assembled and installed on a bag forming apparatus.
Figure 3:
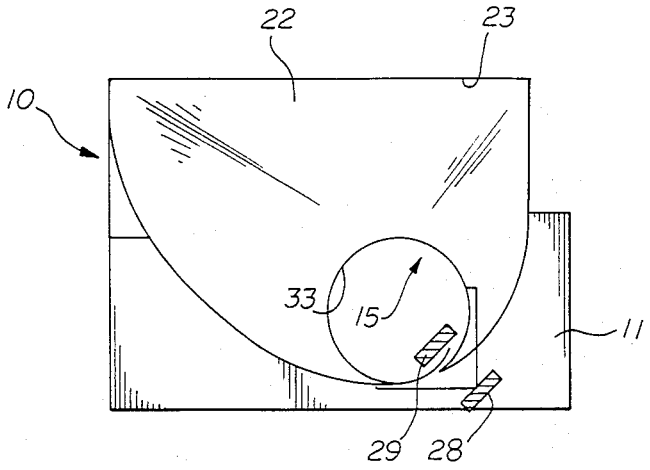
FIG. 3 is a top view, personally in sections, looking for the line 3—3 of FIG. 2.

In FIG. 2, the bag former 10 is shown assembled and installed. Bag former 10 is shown supported on a supporting plate or beam 30 in a conventional bag forming apparatus. A conventional bag forming apparatus has rolls for storing and feeding thin strip material or "tube stock". It has idler rolls over which the tube stock is drawn on the approach to the bag former. The tube stock is drawn over the bag former and downwardly through the tube where it is converted from sheet form into a tube having an overlapping, longitudinally extending edge portion where a seam is to be formed. Conventional tube forming apparatus forms the seam to the center of tube, as viewed from the front of the bag former, and may form a fin seam or a lap seam depending on the bag former design. The tube is fed downwardly where it is received by heat sealing bars and cutters. Either the supporting plate 30 or the heat sealing bar assembly is reciprocated up and down to draw the tube stock through the bag former as will be described more fully below.

In FIG. 2, bag former 10 is shown completely assembled. Supporting plate 11 is secured over an opening (not shown) in supporting 30 by machine screws 31, or the like. Former tube 15 is secured in opening 12 in plate 11 by brazing or welding, or the like, along line 32. The back portion 22 of winged guide member 19 is positioned with edge 24 fitting around edge 17 of former tube 15 and welded or brazed thereto to form an edge portion or crown 33. The crown 33 is, of course, smooth or polished after welding or brazing so that the tube stock can be drawn smoothly thereover without damage.

The flat base portion 20 of winged guide member 19 is secured on base plate 11 by machine screws 34 or the like. Backing member 27 has the shorter leg portion 28 secured to bracket 35 as by brazing, welding, or the like. Bracket 35 is secured on base plate 11 by machine screws or the like. The longer leg 29 of backing member or tongue 27 extends below bag former 10. A metal roll 36 is supported on a suitable supporting arm 37 and is releasably pressed (by springs or the like) toward engagement with the backing tongue 29. In FIG. 2, the tube stock is shown being drawn through the tube former and converted into a tube 38 having edges 39 and 40 overlapped and positioned to be pressed together by the action of roller 36 pressing on backing tongue 29. A strip of releasable double sided adhesive 46 is shown in dotted line which is incorporated into the overlap to form a releasable longitudinally extending seal or seam for the tube.

Figure 4:
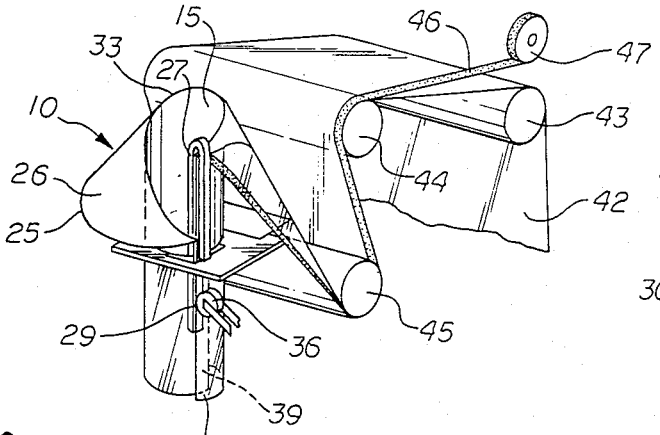
FIG. 4 is an isometric, and partially schematic, view showing the bag forming apparatus with strip tube stock being feed therethrough.
Figure 5:
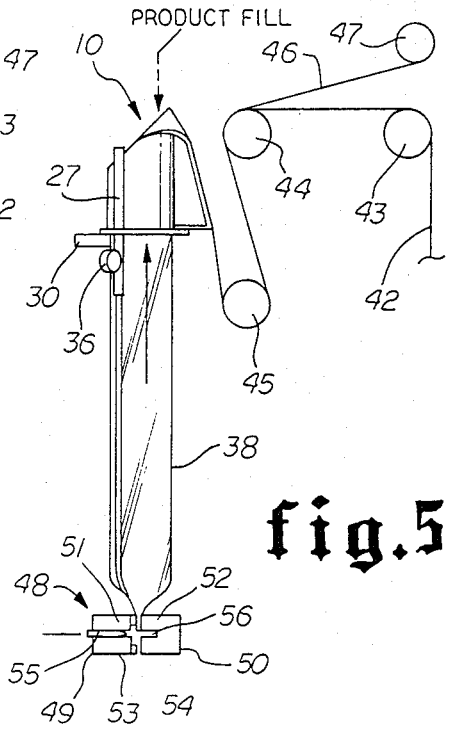
FIG. 5 is a schematic view taken from the side showing the apparatus of FIG. 4 and the cutting bars for sealing and cutting the bags.
Figure 6:
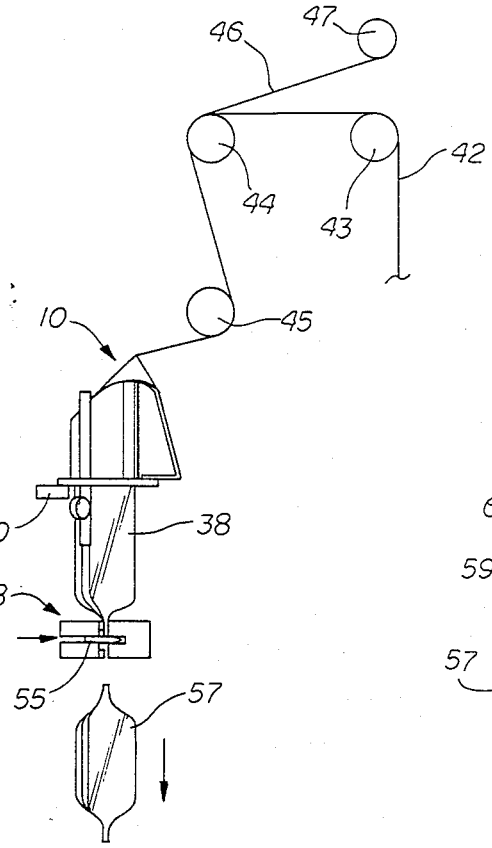
FIG. 6 is a schematic view similar to FIG. 5 showing the apparatus at the point of severing a formed bag.

In FIGS. 4–6, there are shown schematic views of the complete packaging apparatus. A strip of tube stock 42 is fed from a storage roller (not shown) over idler rolls 43, 44 and 45 to tube former 10. Tube stock 42 has a strip of double sided adhesive material 46 applied to it from a supply roll 47. Plastic film tube stock 42 passes over the former wing member 26 and crown portion 33 and downward through former tube 15. As the film tube stock 42 passes over the tube former it is formed into a tube with overlapping edges 39 and 40 as previously described. Roller 36 presses edges 39 and 40 and double sided adhesive strip 46 together against backing tongue 29 to form a releasable longitudinal seal or seam.

In FIGS. 5 and 6 the schematic view of the apparatus shows a sealing and cutting device 48 positioned below the bag former 10 to provide laterally extending end seals or seams on the bags to be formed from the seamed tube stock. Sealing and cutting device 48 consists of two separately movable members 49 and 50 providing two sets of heat sealing bars 51 and 52 (upper seals) and sealing bars 53 and 54 (lower sealing bars). A movable cutter 55 is supported between cutting bars 51 and 53 and moved into slot 56 on sealing members 50.

Sealing bars 51 and 52 form an upper heat seal which constitutes the bottom of an incomplete bag. Sealing bars 53 and 54 form a lower heat seal which constitutes the upper end seal for a completed bag. Cutter blade 55 is operated to cut between the seals formed by the two sets of spaced heat sealing bars to separate a completed bag from the incomplete bag still being formed. In operating the apparatus, the support 30 for tube former 10 may be moved upwardly and downwardly relative to the heat sealing members 48 to cause the feed stock to move through the apparatus. Alternatively, the support 30 could be fixed and the heat sealing members 48 moved upwardly and downwardly to draw the thin tube stock 42 through the apparatus.

Figure 8:
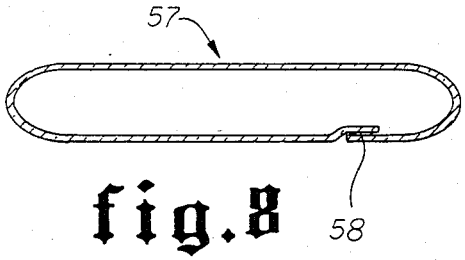
FIG. 8 is a sectional view taken on the line 8—8 of FIG. 7.
Figure 7:
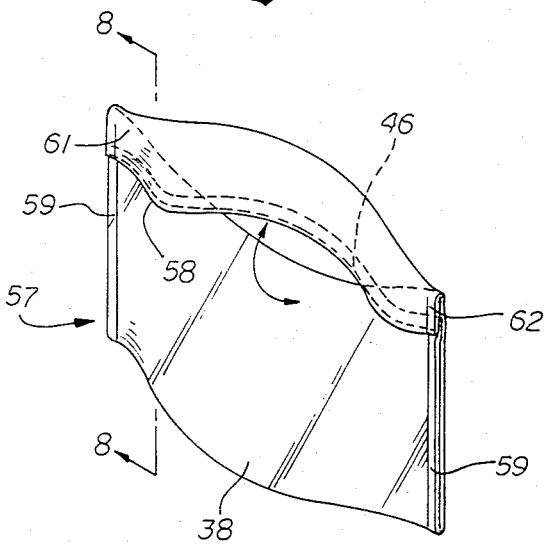
FIG. 7 is a isometric view of a completely formed bag, produced by the apparatus of this invention and showing the releasable seam on the bag.

In FIGS. 7 and 8 there is shown a completed bag formed by the apparatus described above. Bag 57 is formed from a tube 38 of thin tube stock. When the bag is flattened by the heat sealing mechanism 48 at the top and the end seals are formed, the seam 58 is positioned almost completely to the edge of the flattened tube. The end seals 59 and 60, produced by sealing and cutting member 48, extend laterally or transversely of the bag and seal the releasable seam or seal 58 into a fixed position at the extreme edge of the bag. The releasable seam or seal 58 can be opened and reclosed because of the double sided adhesive strip 46 positioned in the seam.

In FIG. 7, it is seen that the seal or seam 58 can be pulled open and can be reclosed as desired. Usually, the opening of seam 58 will necessitate the tearing of the material of the overlapping flap at the end portions 61 and 62. It is necessary to tear the material at this point if the package is to be open fully for easy access to the contents. The fact that the overlapping portion must be torn in this matter provides a security factor to this type of packaging. The reclosable seal or seam 58 is a great convenience to the user but raises the possibility that the packages may be tampered with. The fact that the material must be torn to fully open the package means that any tampering with the package will be apparent from the tear in the material. The packages are filled with the product being packaged during the bag forming operation as will be described below.

OPERATION

The operation of this apparatus should be apparent from the description of the components parts and their mode of assembly, described above. Nevertheless, a detailed description of operation will be given for clarification and for a more thorough understanding of the invention.

As noted above, the tube former 10 is mounted on a support 30 in the tube forming apparatus. The heat sealing bars and cutting mechanism 48 are positioned below the support 34 tube former 10. The support 30 and the sealing bar and cutting mechanism 48 are movable one relative to the other. In this embodiment, the support 30 is movable downward in relation to heat sealing bars 48 which are maintained in a fixed position. This is the embodiment of the invention which will be described. It should be noted, that the support 30 can be maintained in a stationary position and heat sealing bars 48 move upward toward it and subsequently move back. Either of the two types of relative motion is effective to fed the tube stock through the apparatus.

The thin tube stock 42 is fed from a feed roll (not shown) over idler rolls 43, 44, and 45 to the tube former 10. A strip of double sided adhesive 46 is fed from storage roll 47 and applied to one edge of the tube stock 42. The tube stock 42 is drawn over tube former 10 and downwardly through the central tube 15 thereof. The wings 26 of tube former 10 overlap in an off set position relative to the center of the tube former as viewed from the front of the apparatus. The overlap is at the extreme right hand side of the tube former 10, as seen in FIGS. 1, 2, 3, and 4. The thin tube stock 42 is pulled downward through the tube 15 and overlapped with the double sided adhesive strip 46 on the right side of the tube stock so that it is positioned between the overlapping edges of the film which is to form the reclosable seam.

The press roller 36 presses the seam from by edges 39 and 40 and adhesive strip 46 against the backing member or tongue 29 to form a continuous, air-tight longitudinal seam. In FIG. 5, the thin walled tube is shown in a side view after it has retracted to its upwardly extended movement away from the heat seal and cutting mechanism 48. In this position, the tube is filled to a desired level with product introduced along the product fill line shown by a dotted line and arrow at the top of FIG. 5 through the top of tube former 10. When the tube is filled to a sufficient level with the desired product, the sealing and cutting mechanism 48 is opened and the supporting bar 30 on which tube former 10 is mounted is moved downward toward it. When the supporting plate 30 reaches a position where the top of the product fill line, as seen in FIG. 6, is at the proper location for the top seal, the sealing and cutting mechanism 38 is closed to heat seal the top of the completed bag 57 and seal the bottom of tube 38. In this position cutter 55 is actuated to cut bag 57 away from the lower end of tube 38. Next, the supporting bar 30 is moved upward to the position shown in FIG. 5 which pulls the tube stock 42 over tube former 10 to reach the position shown in FIG. 5 just before filling the completed tube 38 with the desired product.

The individual bags which are produced in this apparatus are illustrated in FIGS. 7 and 8. The seal or seam 58 is positioned at the extreme edge of the package 38 and end seals or seams 59 extend across the bag and anchors seal or seam 58 in position along the edge. The seam or seal 58 is air-tight but the edge flap is capable of being opened and reclosed using the double sided adhesive strip 46. As previously noted, the bag can only be fully opened for access by tearing a portion of material at the ends 61 and 62. This provides a visual means for detecting whether the bags have been tampered with. If a bag has been opened far enough to allow any product to be moved or anything to be placed inside it will be necessary to tear the bag near one of the ends 61 or 62 and tampering will be readily apparent.

While this invention has been described fully and completely with special emphasis on a single preferred embodiment, it should be understood that within the scope of the appended claims the invention may be practiced otherwise than as specifically described herein.

I claim:

1. A former for turning a strip of thin tube stock into an elongated tube which comprises a former tube having a curved upper edge tapering from an apex downwardly on opposite sides thereof, said former tube being of sheet metal and separated at one side along a longitudinally extending line with the lowermost edge portion extending behind the uppermost edge portion, a winged guide sheet, of sheet metal secured around said former tube along said curved upper edge and extending outwardly therefrom at an acute angle from the side of said tube, said winged guide sheet having longer and shorter end portions in spaced overlapping relation at one side of said tube and spaced apart with said longer end portion extending to said tube lowermost edge portion and curved inside said shorter end portion, said former tube including a supporting base on which said former tube and winged guide sheet are secured and being adapted to be supported in a tube forming apparatus with said overlapping wing portions being at the side of said former tube and to the side of the tube stock strip being formed into a tube so that a strip of tube stock drawn over said winged guide sheet and through said former tube will be formed into an elongated tube with overlapping edges at the side of the tube and on seaming and flattening in a direction from front and back relative to said former tube will have the longitudinal seam at the side of the flattened tube with the shorter portion of the tube wall overlying the longer portion of the tube wall.

2. A tube former according to claim 1 including a backing tongue member supported on said base and extending through said former tube to a point beyond said tube in the path of movement of said overlapping tube portion.

3. A tube former according to claim 2 in which said backing member comprises a rebent tongue member secured in said base and extending over the crown of said tube former and through said former tube.

4. A tube former according to claim 1 in which said sheet metal former tube includes a metal supporting plate on which said former tube and sheet metal wings are secured and supported on said apparatus with said overlapping sheet metal wings being at the side of said former tube and to the side of the tube stock being formed into a tube.

5. A tube former according to claim 3 in which said sheet metal wings are secured to and around said sheet metal tube with said longer wing portion extending with said lowermost tube edge portion inside said longer wing portion and said uppermost tube edge portion, whereby the tube stock drawn over and through said former is formed into a longitudinally extending tube with an overlap at the side thereof.

6. A packaging apparatus including a winged tube former for forming strip tube stock into a tube on being drawn thereover, and laterally extending, spaced heat seal bars and a cutter positioned therebetween, positioned beyond said tube former, operable to produce lateral end seals converting the tube into bags, forming a top seal on one bag and a bottom seal on another bag and cutting between the seals to sever one bag from the other, in which said former includes a former tube having a curved upper edge tapering from an apex downwardly on opposite sides thereof, said former tube being of sheet metal and separated at one side along a longitudinally extending line with the lowermost edge portion extending behind the uppermost edge portion, a winged guide sheet, of sheet metal, secured around said tube to said curved upper edge thereof to define a crown extending outwardly therefrom at an acute angle from the side of said tube and having longer and shorter side wing portions extending around said tube and overlapping in spaced relation substantially to the side thereof with said longer wing portion extending to said tube lowermost edge portion and curved inside said shorter wing portion, said former tube including a supporting base on which said former tube and winged guide sheet are secured and being supported in said apparatus with said overlapping wing portions being at the side of said former tube and to the side of the tube stock strip being formed into a tube so that a strip of thin tube stock drawn over said winged guide sheet and through said former tube will be formed into an elongated tube with overlapping edges at the side of the tube and on seaming and flattening in a direction from front and back relative to said former tube will have the longitudinal seam at the side of the flattened tube with the shorter portion of the tube wall overlying the longer portion of the tube wall, and said apparatus including means for applying a narrow double sided adhesive strip to one edge of the strip tube stock forming said overlapping tube portion, a backing member positioned beyond said former tube in the path of movement of said overlapping tube portion, a pressure member cooperable with said backing member positioned to press said overlapping tube portion and adhesive strip to form a releasable side seam, and said heat seal bars being positioned to flatten said tube to form said lateral seals with said longitudinal seam positioned substantially at the side and the shorter edge of said tube outside the longer edge of said tube.

7. A packaging apparatus according to claim 6 in which said backing member comprises a rebent tongue member secured in said base and extending over said crown and through said former tube to a point beyond said tube, said press member comprises a roller supported adjacent and urged toward said tongue beyond said former tube, and said overlapping tube portion being drawn between said tongue and rolled to form said side seam.

8. A method of producing packages from thin tube stock which comprises passing a strip of thin tube stock over a winged tube former which comprises a former tube having a curved upper edge tapering from an apex downwardly on opposite sides thereof, said former tube being of sheet metal and separated at one side along a longitudinally extending line with the lowermost edge portion extending behind the uppermost edge portion, a winged guide sheet, of sheet metal secured around said former tube along said curved upper edge and extending outwardly therefrom at an acute angle from the side of said tube, said winged guide sheet having longer and shorter end portions in spaced overlapping relation at one side of said tube and spaced apart with said longer end portion extending to said tube lowermost edge portion and curved inside said shorter end portion, said former tube including a supporting base on which said former tube and winged guide sheet are secured and being adapted to be supported in a tube forming apparatus with said overlapping wing portions being at the side of said former tube and to the side of the tube stock strip being formed into a tube so that a strip of tube stock drawn over said winged guide sheet and through said former tube will be formed into an elongated tube with overlapping edges at the side of the tube and on seaming and flattening in a direction from front and back relative to said former tube will have the longitudinal seam at the side of the flattened tube with the shorter portion of the tube wall overlying the longer portion of the tube wall, and through said former tube so that said thin tube stock forms a tube with an overlapping portion substantially to the side thereof with the shorter portion of the tube wall overlying the longer portion of the tube wall, applying a narrow double sided adhesive strip to one edge of said strip before passing over said former whereby said overlapping portion has said adhesive strip positioned therebetween, moving said overlapping tube portion between a backing member positioned beyond said former tube and a pressure member positioned to press said overlapping tube portion and adhesive strip thereagainst to form a releasable side seam, flattening said tube with said seam at the side and passing the flattened tube between laterally extending, spaced heat seal bars with a cutter positioned therebetween in a direction from front and back relative to said former tube, operating said heat seal bars and cutter to produce lateral end seals converting the tube into bags, forming a top seal on one bag and a bottom seal on another bag and cutting between the seals to sever one bag from the other.

9. A method according to claim 8 in which said heat seal bars and cutter, and said tube former are moved relative one to the other, and subsequent relative movement is effective to draw said strip through the tube former.

10. A method according to claim 9 in which said heat seal bars and cutter are moved to a point near said tube former and operated to form a bottom seal on the tube being formed, a top seal on a bag previously formed and said cutter operated to cut the finished bag from the unfinished bag, and said heat seal bars and cutter are then moved, while still closed, to a point away from said tube former to draw the tube stock therethrough, said heat seal bars then being opened and moved to said position near said tube former where they are again closed to form said top and bottom seals and to cut off the finished bag.

11. A method according to claim 8 in which the tube which is formed is filled through the tube of said tube former with a selected amount of product to be packaged after said bottom seal is formed and before said top seal is formed.

12. A method according to claim 9 in which the tube which is formed is filled through the tube of said tube former with a selected amount of product to be packaged after said bottom seal is formed and before said top seal is formed.

13. A method according to claim 10 in which the tube which is formed is filled through the tube of said tube former with a selected amount of product to be packaged after said bottom seal is formed and before said top seal is formed.

* * * * *